US005347859A

United States Patent [19]

Henneuse et al.

[11] Patent Number: 5,347,859

[45] Date of Patent: Sep. 20, 1994

[54] DYNAMOMETRIC MEASURING DEVICE FOR A DRILL PIPE

[75] Inventors: Henri Henneuse, Billere; Frédéric Clayer, Jurancon; Jean-Luc Tanguy, Pau; Jean Lutz, Jurancon, all of France

[73] Assignee: Societe Nationale Elf Aquitaine (Production), France

[21] Appl. No.: 655,436

[22] PCT Filed: Jun. 26, 1990

[86] PCT No.: PCT/FR90/00467

§ 371 Date: Mar. 18, 1991

§ 102(e) Date: Mar. 18, 1991

[87] PCT Pub. No.: WO91/00413

PCT Pub. Date: Jan. 10, 1991

[30] Foreign Application Priority Data

Jun. 28, 1989 [FR] France ..... 89 08649

[51] Int. Cl.[5] ..... E21B 47/00

[52] U.S. Cl. ..... 73/151; 340/854.3; 340/855.7; 439/27

[58] Field of Search ..... 73/151, 773, 769; 175/40, 50; 340/854.1, 854.2, 854.3, 854.4, 854.5, 854.6, 854.7, 854.8, 854.9, 855.7, 855.9; 439/12, 13, 20, 21, 22, 27

[56] References Cited

U.S. PATENT DOCUMENTS

| | | | |
|---|---|---|---|
| 1,665,822 | 4/1928 | Shimizu | 73/769 |
| 3,047,827 | 7/1962 | Stoddard | 439/22 |
| 3,614,726 | 10/1971 | Richter, Jr. et al. | 340/854.3 |
| 3,626,482 | 12/1971 | Quichaud et al. | 73/151 |
| 3,714,822 | 2/1973 | Lutz | 175/25 |
| 3,855,857 | 12/1974 | Claycomb | 73/151 |
| 4,190,804 | 2/1980 | Pyne et al. | 340/599 |
| 4,545,261 | 10/1985 | Gebben | 73/769 |
| 4,715,451 | 12/1987 | Bseisu et al. | 175/40 |
| 4,821,563 | 4/1989 | Maron | 73/151 |

FOREIGN PATENT DOCUMENTS 3728968 3/1989 Fed. Rep. of Germany .

OTHER PUBLICATIONS

Thomas and Rosa, "Circuits and Signals: An Introduction to Linear and Interface Circuits", NY, John Wiley & Sons, 1984, pp. 164–166.

Horowitz and Hill, "The Art of Electronics", Cambridge, Cambridge University Press, 1980, pp. 53–55, 95 & 96.

*Primary Examiner*—Hezron E. Williams
*Assistant Examiner*—Michael Brock
*Attorney, Agent, or Firm*—Bacon & Thomas

[57] ABSTRACT

A dynamometric measuring device for a drill pipe which includes, firmly attached to the rotating pipe, sensors disposed in a groove on the pipe and electronics for conditioning the signals supplied by the sensors. The measurement signals are transmitted by a commutator-fixed brush assembly to a fixed, non-rotating part. By providing follower-amplifiers of very low output impedance on the commutator, rotating, portion of the assembly and follower-amplifiers of very high input impedance on the fixed brush side of the assembly, the transmission of signals is carried out at zero current. To assure high quality signal analysis, a separation circuit on the fixed brush side of the assembly separates the DC and AC components of the signal prior to transmission to the surface.

8 Claims, 4 Drawing Sheets

DYNAMOMETRIC MEASURING DEVICE FOR A DRILL PIPE

The present invention concerns a dynamometric measuring device for a drill pipe.

To produce a dynamometric device to measure forces and stresses exerted on the drill pipe, the major problem is not to take the measurement but to transmit it under optimal conditions to the data-acquisition unit responsible for processing it. Thus, taking into account the length of the cables linking the measuring unit to the data-acquisition unit, it is essential to guard against all conceivable causes of deterioration of the signals to be transmitted.

Furthermore, it is necessary to transmit the electrical signals from the rotating assembly constituted by the drill string to a fixed reference point constituted by the mast.

Finally, it is necessary to take steps to prevent the transmitted signals from being distorted by the passage from the moving parts to the fixed parts.

A first object of the invention is therefore to alleviate at least one of these disadvantages.

This object is achieved by the fact that the dynamometric measuring device for a drill pipe comprises, firmly attached to the rotating pipe, sensors and electronics for conditioning the signals supplied by these sensors, these electronics being firmly attached to the rotating parts, the sensors being disposed in a groove and the measurement signals being transmitted to a fixed part by a rotating commutator-fixed brush assembly, the crossing of the commutator-brush assembly being carried out at zero current.

According to another feature of the invention, the measurement signals from each sensor are transmitted by a channel constituted by an independent track and an earth track, each of the two tracks being in contact with a double pair of brushes, each brush having a characteristic resonant frequency.

According to another feature, the device comprises sensors for measuring the traction, the torsion, the longitudinal and transverse accelerations, the temperature and the speed of rotation of the drill pipe.

Another object of the invention is to ensure a compromise between the maneuverability and the location of the electronics.

This object is achieved by the fact that the electronics, firmly attached to the rotating parts and connected between the sensors and the rotating commutator, are constituted by amplifier stages of low output impedance for each measurement channel.

According to another feature, the power supply to the rotationally driven electronics is ensured by two supplementary channels.

Another object of the invention is to improve significantly the information, from the sensors, that one can exploit.

This object is achieved by the fact that a second electronic circuit is mounted on the fixed part connected to the brushes, this electronic circuit comprising, on the output side of each brush, a stage of follower-amplifiers of very high input impedance.

Another object of the invention is to limit to a minimum the number of compatible channels while maintaining the highest quality of signal analysis.

This object is achieved by the fact that the second electronic circuit comprises, on the output side of each follower-amplifier, a separation circuit for the DC component and a separation circuit for the AC component of the signal.

According to another feature of the invention, the separation channel of the DC component comprises a low-pass filter of cut-off frequency equal to 10 kHz in series with a line amplifier.

According to another feature of the invention, the separation channel of the AC component comprises a capacitor for cutting off the DC component, in series with a variable band-pass filter having a lower cut-off frequency of 0.1 Hertz and an upper cut-off frequency of 1 kHz and in series with the line amplifier.

Another object of the invention is to constitute a device that is reliable, sealed and flameproof.

This object is achieved by the fact that the assembly is mounted in a volume limited at its ends by upper and lower collars which are mounted so as to rotate with respect to the drill pipe and to form a seal, and a cylindrical sheath of length corresponding to the distance separating the upper and lower collars so as to form a sealed annular space between the drill pipe and the interior of the sheath.

Other features and advantages of the present invention will appear more clearly on reading the description below given with reference to the attached drawings in which.

Figure 1:
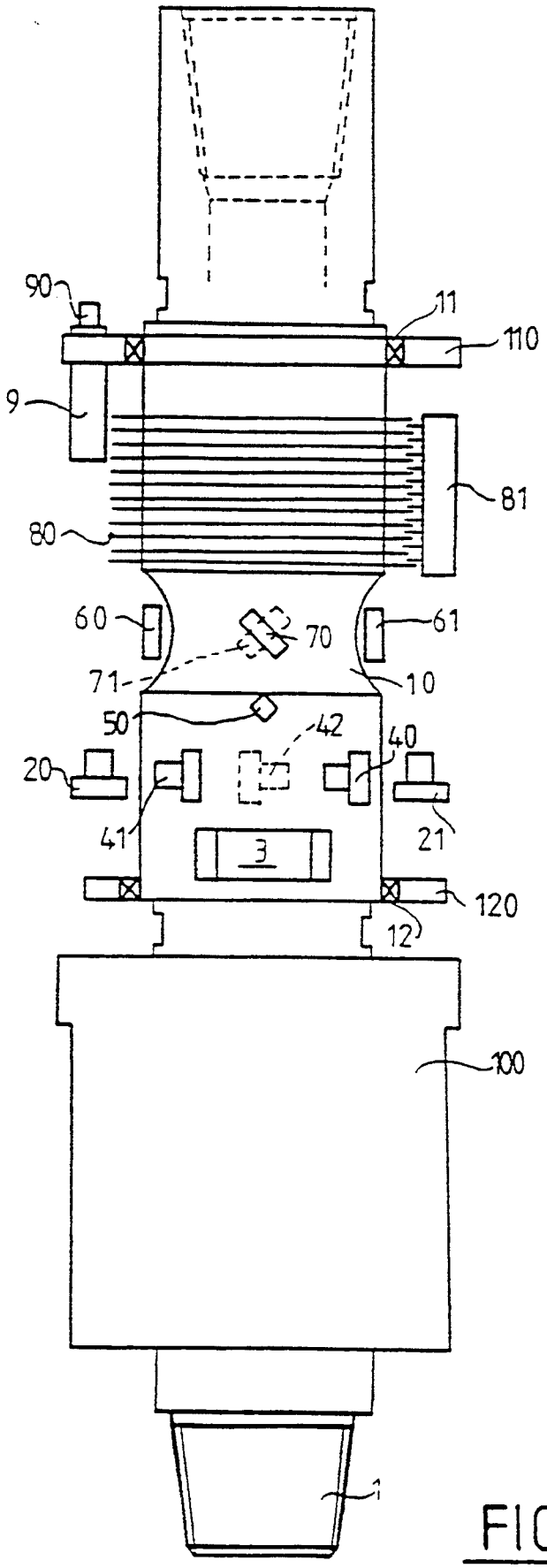
FIG. 1 represents an overall view of the dynamometric measuring device.
Figure 2:
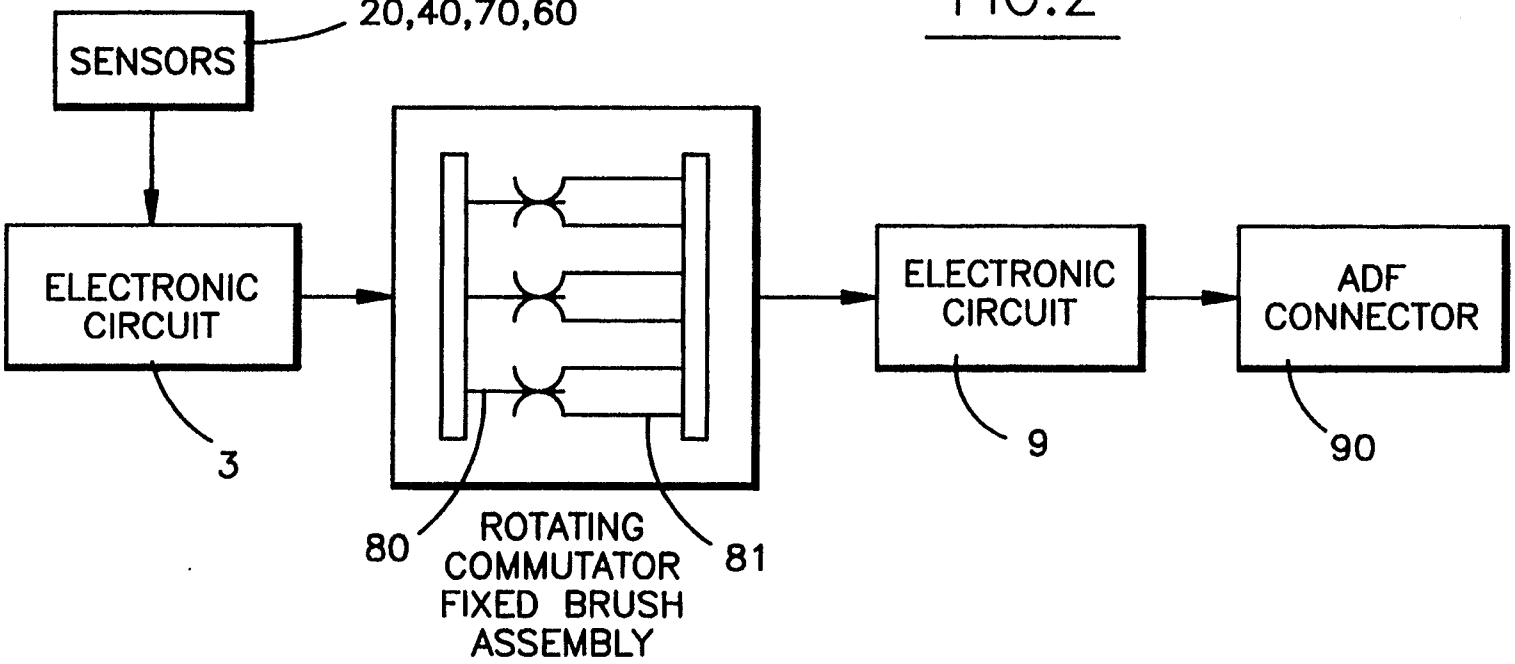
FIG. 2 represents the block diagram of the electrical and electronic components of the assembly.

The dynamometric measuring device is placed on a drill pipe (1) in a space delimited by an upper collar (110) mounted so as to rotate and to form a seal with respect to the pipe by means of a bearing (11). Likewise, a lower collar (120) is mounted so as to rotate, by means of a bearing (12), on the pipe (1). A sheath (100) is then put into place to form a sealed volume delimited by the upper collar (110), the lower collar (120) and the internal diameter of the sheath (100).

On the inside of the annular volume included between the sheath (100) and the pipe (1) are disposed, in a groove (10) of the pipe (1), traction gauges (60,61), a pair (70,71) of gauges forming a torsion gauge, a temperature gauge (50), a pair of longitudinal accelerometers (20,21) and three transverse accelerometers (40,41,42). Each of these gauges constitutes a measurement channel. An electronic circuit (3) for processing the signals supplied by these various sensors is mounted, firmly attached to the drill pipe (1), on the inside of the volume delimited by the collars. Above the groove (10) and firmly attached to the pipe (1) is mounted a set of tracks forming a rotating commutator (80). A pair of tracks is associated with each measurement channel. The signals delivered by each pair of tracks are taken by two pairs of brushes associated with each channel and represented by the reference (81). The brush support assembly (81) is firmly attached to the upper collar (110) which is itself firmly attached, by means of a rotating stop-arm, to the fixed part constituted by the drilling mast. The brushes are connected to a second electronic circuit for processing the signals from each measurement channel of which the outputs are fed via a connector (90) to a power cable of N pairs individually screened by an outer screen for N/2 measurement channels. The signals delivered by the sensors (20,40,70,60) are fed to a first electronic circuit (3) situated on the input side of the rotating commutator (80) and of the fixed brush assembly (81). The signals recovered by the fixed brush assembly (81) are fed to an electronic circuit (9) situated on the output side of these signals, and the outputs of this electronic circuit are fed to an ADF connector (90) for transmission to the screened cable. In addition to each measurement channel constituted by a pair of tracks of the rotating commutator, the commutator-brush assembly comprises two other pairs of tracks for the purpose of transmitting the supply from the fixed electronic circuit to power the sensors and the rotating electronic circuit (3).

Figure 4:
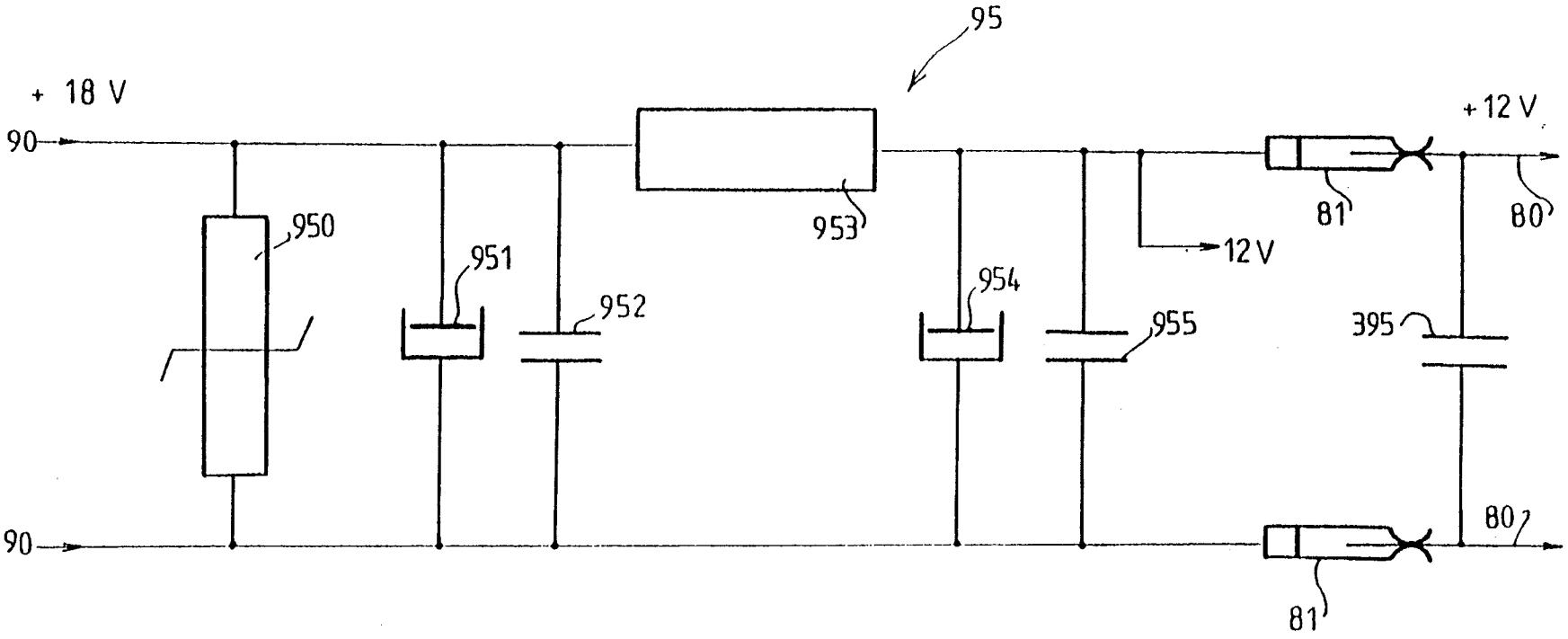
FIG. 4 represents the diagram of the power supply part of the electronic circuit.

A first pair of tracks of the commutator (80) is connected by a capacitor (395), as shown in FIG. 4. This pair of tracks supplies on one side a voltage of +12 volts and on the other side the earth to the rotating electronic circuit. The pair of tracks is connected to a double pair of brushes (81) connected to the terminals of a capacitor (955), which is itself connected in parallel to the terminals of a capacitor (954). This capacitor (954) is connected on one side to the output of a regulating circuit (953) and on the other side to one of the terminals of a capacitor (952) of which the other terminal is connected to the input of this regulating circuit (953). Another capacitor (951) is also connected in parallel between the terminals of the capacitor (952). Finally a self-protecting device (950) is connected in parallel to the terminals of the capacitor (951) and receives, by the connector (90), on one side the supply of +18 volts and, on the other side, the earth.

A circuit identical to the one shown in FIG. 4 and bearing the reference (96) will be used to constitute the negative-supply of −12 volts necessary for the functioning of the sensors and of the rotating electronics (3).

Figures 3A, 3B:
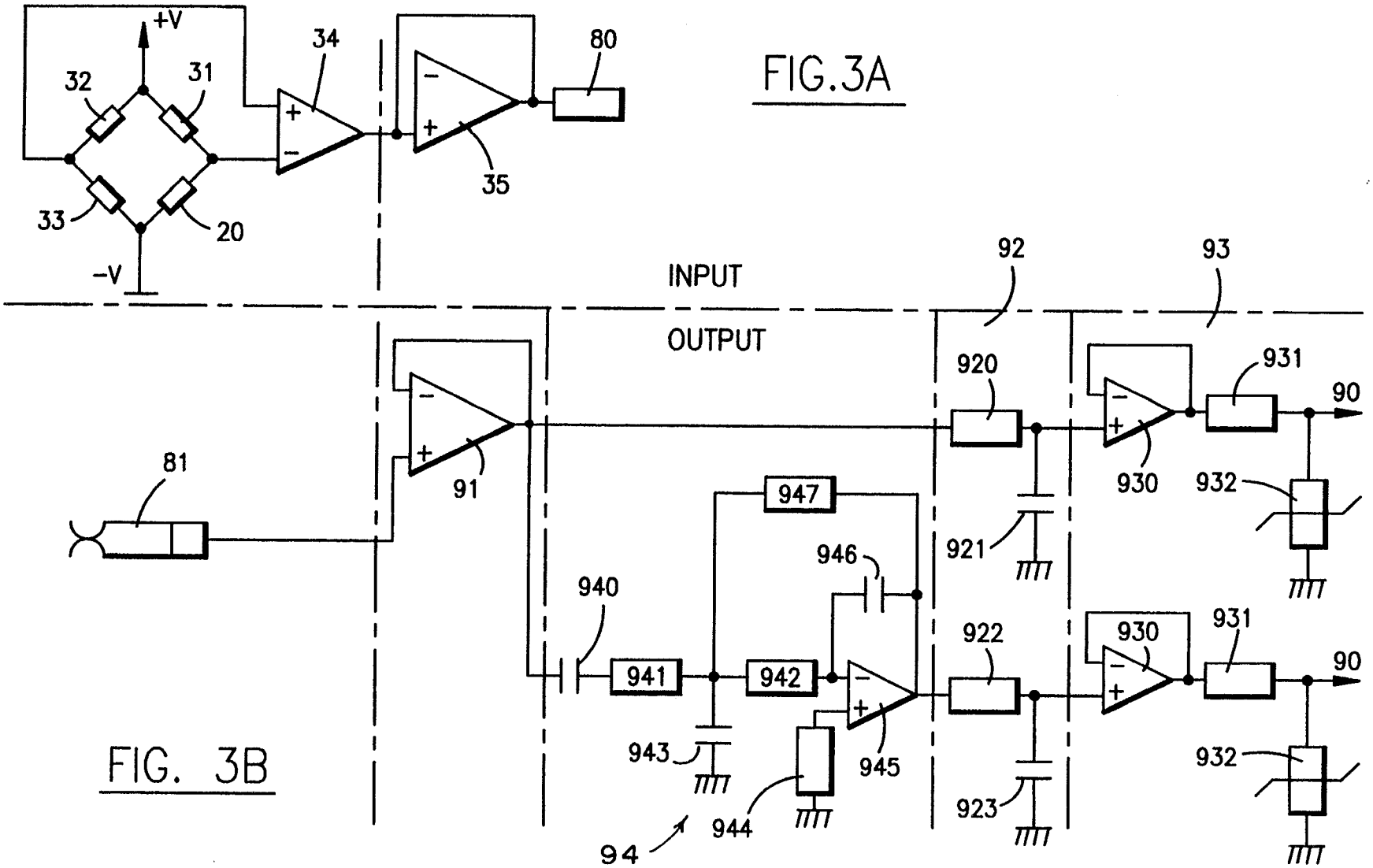
FIG. 3A represents the diagram of the rotating electronic circuit situated on the input side of the brush-commutator.
FIG. 3B represents the diagram of the fixed electronic circuit situated on the output side of the brush-commutator.

A measurement channel of the device constituting the electronic circuit (3) situated on the input side is shown in FIG. 3A. This measurement channel comprises a gauge (20) constituted, for example, by a Wheatstone bridge constituted by a combination of four resistances (20,31,32,33). The diagonal of this bridge is connected, on one side to the positive terminal, and on the other side to the negative terminal of a differential amplifier (34), while the other diagonal of this Wheatstone bridge is connected, on one side to the +12 volt supply, and on the other side to the −12 volt supply. The output of the differential amplifier (34) is connected to the positive input of a second differential amplifier (35) of which the output is looped back to its negative input. This second amplifier (35) constitutes a follower stage of very low output impedance. The output of this amplifier (35) is fed onto one ring of the commutator assembly (80), the other ring of the commutator constituting the measurement channel is formed by the earth.

The signal fed by the pair of rings is taken by a double pair of brushes (81, FIG. 3B) and fed to the positive input of a differential amplifier (91) of which the output is looped back to its negative input. The output of this amplifier (91) is fed, on one side to a circuit (92) for extracting the DC component, and on the other side to a circuit (94) for extracting the AC component of the measurement signal. These stages are followed by a line amplifier and protection stage. The amplifier (91) constitutes a follower stage of very high input impedance. The combination of follower stage of low output impedance with the follower stage of very high input impedance situated respectively on the input and output sides of the commutator-brush assembly, ensures that the measurement signals are transmitted at zero current. This allows a relatively wide pass-band to be used and the precision of the measurement to be retained, although the state of cleanliness or of wear of the discs and brushes of the commutator constitutes the principal source of noise within the dynamometric measuring device. Moreover, the separation of the DC components and the AC components, and the final amplification of the latter before transmitting, allows a significant improvement to be made to the information which is going to be subsequently exploited. The separation stage of the DC components of the measurement signals is an integrating circuit that performs two functions. First, it acts as a low-pass filter passing only that portion of the input measurement signal having a frequencies below 10 kHz. Second, the integrating circuit integrates, or averages, the filtered signal to derive the DC component. The integrating circuit is formed by a resistance (920), a capacitor (921), and a line amplifier (930). As depicted in FIG. 3A, resistance (920) is mounted in parallel with capacitor (921) between the output of the amplifier (91) and earth. The common point of resistance (920) and capacitor (921) is connected to the positive input of the line amplifier (930). The output of the line amplifier is looped back to its negative input. The output of line amplifier (930) is fed to resistance (931) of which the output is connected on one side to the connector (90) and on the other side to earth via a protection element (932), such as, for example, a Zener diode. The circuit (94) for extracting the AC component is constituted by a capacitor (940) connected to the output of the amplifier (91). This capacitor (940) is connected at its other side to earth by a circuit constituted by a resistance (941) in series with a capacitor (943). The common point of the resistance (941) and the capacitor (943) is connected on one side, by a resistance (942), to the negative input of a differential amplifier (945) and on the other side, by a resistance (947), to the output of this amplifier (945). The output of the amplifier (945) is also connected by a capacitor (946) to the negative input of the latter. The positive input of the amplifier (945) is connected by a resistance (944) to earth. The output of this amplifier (945) is fed to a low-pass filter constituted by a resistance (922) connected by a capacitor (923) to earth. The common point of the resistance (922) and the capacitor (923) is connected to the positive input of a line amplifier (930) of which the output is looped back to the negative input. The output of this amplifier is fed to a resistance (931) connected, on one side, to the connector (90), and on the other side by a fuse (932) to earth. The capacitor (940) makes it possible to eliminate the DC component of the signals and the circuit constituted by the amplifier (945), the resistances (941,942,944,947), the capacitors (943, 946) constitute a band-pass filter having a lower cut-off frequency of 0.1 Hz. and an upper cut-off frequency of 1 kHz.

The separation of the DC and AC components, and the final amplification of the latter before transmission allows the information that one can expect to exploit after measurement to be significantly improved. For example, the separate transport of the DC component and of the AC component amplified 300 times allows one to expect a signal-to-noise ratio 300 times greater after transmission.

Assuming that this AC component is subsequently processed by a digital unit, this is a non-negligible increase in resolution which is made possible by the technique of separating the DC and AC components of the signal.

The separation of the DC and AC components is carried out on the output side of the commutator to reduce the number of commutator rings and thus the volume and the cost of the device.

The device so constructed results in less space being required, a minimum number of parts, and optimum reliability and quality of measurement.

Finally, the presence of as many line amplifiers as channels to transmit on the input side of the connector device (90) makes it possible to improve the characteristics of the transmitted signals and in particular to reduce the level of noise from the transmission, especially the equipment ages. Moreover, the protection stages provided either at the output stages, that is to say after the line amplifiers, or at the power input stages, protect the equipment against hazards in the field or more simply against interference arising from lightning or from switching in large electric machines located in the vicinity.

Other modifications of the invention, available to a person skilled in the art, also come within the spirit of the invention.

We claim:

1. Dynamometric measuring device for a rotating drill pipe comprising:

a plurality of sensors disposed in a groove in the rotation drill pipe, each of said sensors providing means for outputting a measurement signal over a respective measurement channel;

a first electronic circuit attached to the rotating drill pipe for conditioning the signals supplied by these sensors and including a stage of follower-amplifiers of very low output impedance;

a commutator-brush assembly for transmitting the signals from the first electronic circuit attached to the rotating drill pipe to a fixed part, said commutator-brush assembly including a commutator mounted on the rotating drill pipe and a fixed-brush assembly mounted on the fixed part; and a second electronic circuit mounted on the fixed part, wherein said circuit comprises on an output side of the fixed-brush assembly, means including a stage follower-amplifiers of very high input impedance for receiving said signals transmitted to the fixed part and for thereby causing transmission of the signals from the first electronic circuit attached to the rotating drill pipe to be carried out at zero current, and, on an output side of each follower-amplifier, a separation circuit for a DC component and a separation circuit for an AC component of each of said signals.

2. Device according to claim 1, wherein the signal from at least one measurement channel supplied by each sensor is transmitted by an independent track of the commutator and an earth track.

3. Device according to claim 1, wherein a power supply to the first electronic circuit is ensured by two supplementary channels.

4. Device according to claim 1, wherein the electronics, attached to the rotating parts and connected between the sensors and the rotating commutator, are constituted for each channel by an amplifier stage of low output impedance.

5. Device according to claim 4, wherein said plurality of sensors measure the traction, the torsion, the longitudinal accelerations, the transverse accelerations, the temperature and the speed of rotation of the drill pipe.

6. Device according to claim 1, wherein the separation circuit for the DC component comprises a low-pass filter of cut-off frequency equal to 10 kHz in series with a line amplifier and a protection element.

7. Device according to claim 1, wherein the separation circuit for the AC component of the signal comprises a capacitor for cutting off the DC component in series with a variable band-pass filter having a lower cut-off frequency of 0.1 Hertz and an upper cut-off frequency of 1 kHz, a line amplifier and a protection circuit.

8. Device according to claim 1, wherein the assembly is mounted in a volume limited at its ends by upper and lower collars, which are mounted so as to form a seal and to rotate with respect to the drill pipe, and a cylindrical sheath of length corresponding to the distance separating the upper and lower collars so as to form a sealed annular space between the drill pipe and the interior of the sheath.

* * * * *